US007376987B2

(12) United States Patent
Barnes

(10) Patent No.: US 7,376,987 B2
(45) Date of Patent: May 27, 2008

(54) MULTI-PURPOSE CONVERTIBLE BED ASSEMBLY

(76) Inventor: Dana Barnes, 10901 Village Bend La. #1105, Houston, TX (US) 77072

( * ) Notice: Subject to any disclaimer, the term of this patent is extended or adjusted under 35 U.S.C. 154(b) by 307 days.

(21) Appl. No.: 11/218,143

(22) Filed: Sep. 1, 2005

(65) Prior Publication Data

US 2007/0044234 A1 Mar. 1, 2007

(51) Int. Cl.

| | |
|---|---|
| ***A61G 7/01*** | (2006.01) |
| ***A61G 7/02*** | (2006.01) |
| ***A61G 7/04*** | (2006.01) |
| *A61G 11/00* | (2006.01) |

(52) U.S. Cl. ..... 5/93.2; 5/2.1; 5/93.1

(58) Field of Classification Search ..... 5/2.1, 5/93.2, 93.1, 95, 99.1, 100, 425, 428, 429
See application file for complete search history.

(56) References Cited

U.S. PATENT DOCUMENTS

| | | | | |
|---|---|---|---|---|
| 4,450,597 | A * | 5/1984 | Hull | 5/2.1 |
| 5,173,974 | A * | 12/1992 | Proano et al. | 5/93.2 |
| 5,604,941 | A * | 2/1997 | Rom an | 5/95 |
| 5,715,551 | A * | 2/1998 | Proano et al. | 5/93.2 |
| 7,096,525 | B2 * | 8/2006 | Briere | 5/93.2 |
| 2003/0037372 | A1 * | 2/2003 | Andriunas et al. | 5/95 |
| 2005/0005352 | A1 * | 1/2005 | Waldman et al. | 5/93.2 |
| 2005/0022302 | A1 * | 2/2005 | Johnson | 5/93.2 |

* cited by examiner

*Primary Examiner*—Alexander Grosz

(57) ABSTRACT

The present invention discloses an improved multi-purpose convertible bed assembly. The bed assembly main components include a head board, foot board, a first side panel, a second side panel, and a mattress support frame. The mattress support frame comprises a first bed frame and a second bed frame of substantially the same size and shape. A single bed frame supports a mini-size crib. The first and second frame can be interconnected into a rectangular structure to support a full size crib. The head board and footboard have substantially the same size and shape. Each foot board and head board are supported by a pair of adjustable leg members. Additionally, a telescopically L-shape bracket member is mounted into the top side of each foot board and head board. The first side panel and second side panel have substantially the same size and shape. Each side panel further includes a first section and a second section which are interconnected utilizing an adjustable sliding mechanism which allows the user to adjust the length of the bed between a full size crib and a mini-size crib. The main components of the bed assembly can be assembled and converted into various configurations including a mini-crib, a full-size crib, a sofa crib, bedside crib, day bed, toddler bed, and security gates.

27 Claims, 13 Drawing Sheets

MULTI-PURPOSE CONVERTIBLE BED ASSEMBLY

BACKGROUND

Cribs are a necessity for a mother of a newborn infant. As an infant matures the sleeping arrangements of the infant changes. With a newborn, because the parents want the baby near them, a small crib or bassinet is desired. As the infant gains weight and becomes more independent, the parents desire a secure full size crib. Then, as the child becomes a toddler a toddler bed along with security gates are desired. If a parent purchases all of these products independently, they could be expensive. As the infant matures the parents normally, take these products down and put them in storage, sells them, or gives them away. The present invention provides the parents an improved multi-purpose crib bed assembly that meets the child sleeping arrangements from infancy through the toddler age of the child.

SUMMARY

The present invention discloses an improved multi-purpose convertible bed assembly. The bed assembly main components include a head board, foot board, a first side panel, a second side panel, and a mattress support frame. The mattress support frame comprises a first bed frame and a second bed frame of substantially the same size and shape. A single bed frame supports a mini-size crib. The first and second frame can be interconnected into a rectangular structure to support a full size crib. The head board and footboard have substantially the same size and shape. Each foot board and head board are supported by a pair of adjustable leg members. Additionally, a telescopically L-shape bracket member is mounted into the top side of each foot board and head board. The first side panel and second side panel have substantially the same size and shape. Each side panel further includes a first section and a second section which are interconnected utilizing an adjustable sliding mechanism which allows the user to adjust the length of the bed between a full size crib and a mini-size crib.

The main components of the bed assembly can be assembled and converted into various configurations including a mini-crib, a full-size crib, a sofa crib, bedside crib, day bed, toddler bed, and security gates. In several of these configurations, the headboard and the foot board are connected in a perpendicular relation at opposing ends of the mattress support frame. The first side panel and the second side panel are connected in a perpendicular relation on opposing sides of bed frame forming a box like structure. The side panels are configured to operate as stand alone adjustable security gates.

DETAILED DESCRIPTION

Figure 1:
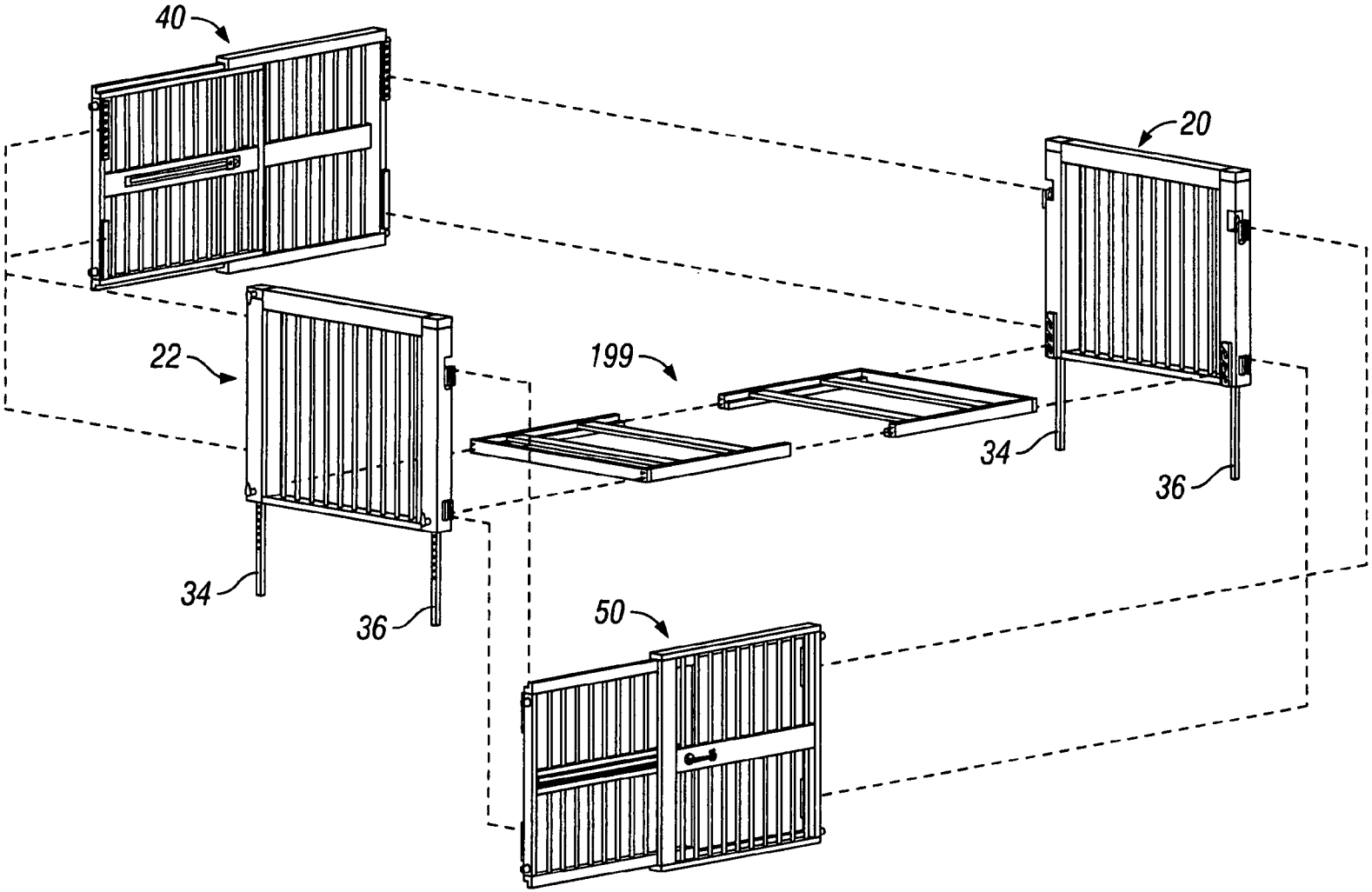
FIG. 1 illustrates an exploded view of the main elements of the crib.

The major components of an improved multipurpose convertible bed assembly are shown in FIG. 1. The convertible bed assembly further comprises head board (20), footboard (22), first side panel (40), second side panel (50), and mattress support assembly (199). The convertible bed assembly parts can be manufactured as a kit. The convertible bed assembly can be configured into various configurations including a mini-crib, full size crib, day bed, toddler bed, sofa bed, security gates and bed side crib as described below. The crib components can be made of wood or strong durable plastic or another suitable material.

Figure 2:
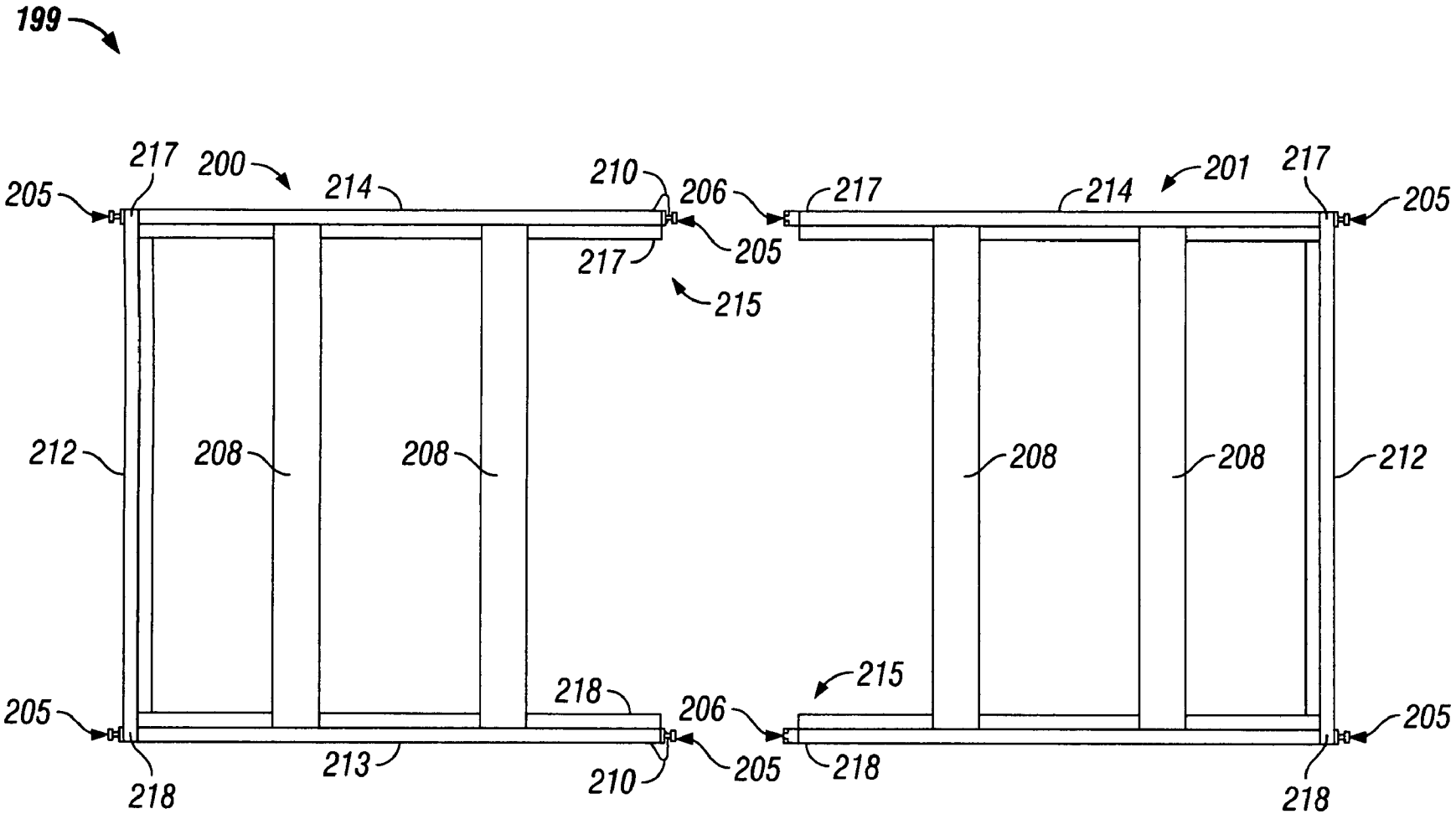
FIG. 2 illustrates a side view of the mattress support frame.

Referring to FIG. 2, there is shown a top view of mattress support assembly (199). Mattress support assembly (199) further comprises first base frame (200) and second base frame (201) which are substantially identical in design. Each base frame (200, 201) has a partially enclosed rectangular shape and is further defined by a closed side (212), an opposing open side (215) and two parallel edges (213, 214). However, first base frame 200 is slightly larger than second frame 201. Closed side (212) and open side (215) of each base frame (201,200) are further defined by first corner (217) and second corner (218). First base frame (200) supports a mini-size bed frame. However, first base frame (200) and second base frame (201) are interconnected to support a full size bed frame. Additionally, slats (208) are vertically and removably mounted across the two parallel edges (213) and (214). Slats (208) are inserted to support the mattress within the assembled bed frame structure. In the preferred embodiment parallel edges (213, 214) of first base frame 200 is slightly larger to support the mini-crib. For first base frame 200 parallel edges 213, 214 are approximately 29 inches while parallel edges 213, 214 of second base frame 201 is approximately 24 inches in length.

First base frame (200) further comprises frame male connector (205) mounted at each corner (217, 218) of closed side (212) and open side (215). However, second base frame (201) further comprises frame female connector (206) connected to opposing corners (217) and (218) of open side (215) while frame male connector 205 is connected to opposing corners 217 and 218 of closed side 212.

Figure 3:
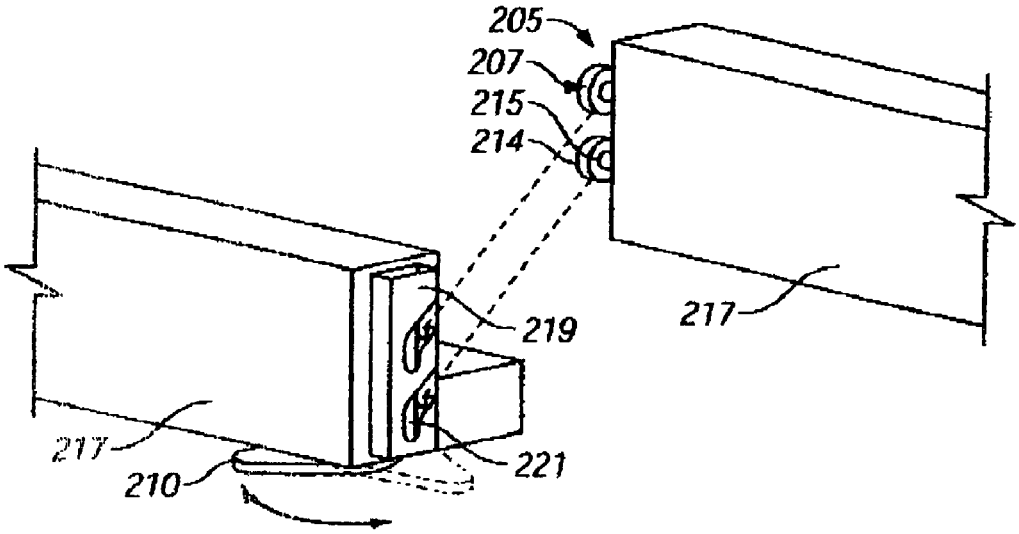
FIG. 3 illustrates the locking mechanism which supports the mattress support frame.

Referring to FIG. 3, each frame male connector 205 further comprise at least one locking pin (207) protruding horizontally outward. As shown in the preferred embodiment, there are two locking pins (207) which are preferably made of a strong metal. Locking pin 207 further comprises an elongated rod 215 with a circular shaped head formed at one end. As depicted, the opposing end of rod 215 is fixably mounted to a corner (217, 218).

Each frame female connector (206) further comprise a bracket member (219) mounted to the flat surface area of corner (217) of open side (215) of second base frame (201). Bracket member (219) further comprises two diagonally oriented slots (221) with each slot having a circular opening at one end for receiving the head of locking pin (207) and allowing locking pin (207) to slide downward within slot (221) and lock in place.

Support member (210) is rotatably mounted to the underside of opposing corners (217 and 218) of opened side (215) of first bed frame (201) as shown in FIG. 2. As shown in FIG. 3, Support member (210) can be a flat plate member which rotates in a horizontal orientation. Additionally, when support member (210) is rotated horizontally outward, Support member (210) is dimensioned to accommodate the length of the connection between frame female connector (206) and frame male connector (205). Support member (210) is preferable made of a strong metal material which can support the connection between frame female connector (206) and frame male connector (205) and prevent sagging when assembling mattress support assembly (199) as shown in FIG. 1. In use when assembling a full size crib, support member (210) is rotated clockwise or counterclockwise underneath the connection between frame female connector (206) and frame male connector (205) for providing support and preventing sagging.

Figure 4:
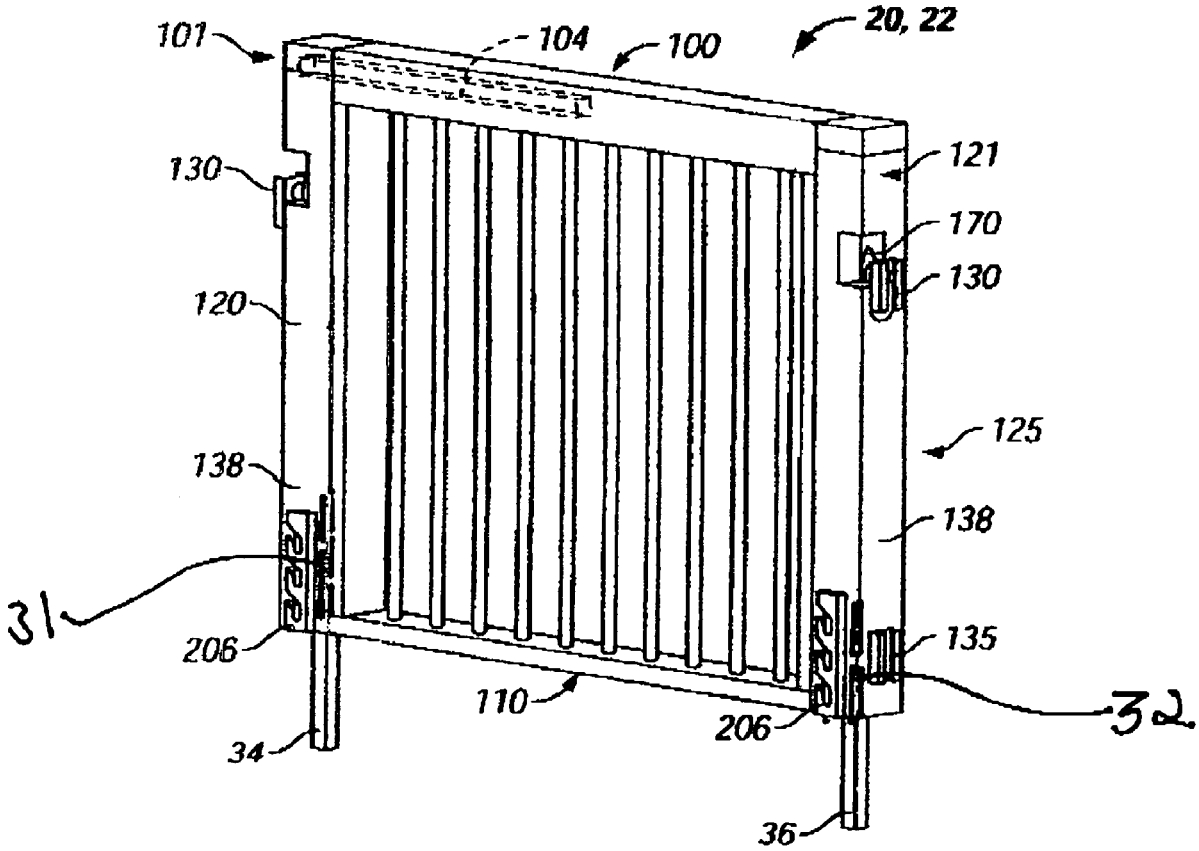
FIG. 4 illustrates a side view of the headboard and footboard.

Referring to FIG. 4, there is shown a frontal view of headboard (20) or foot board (22). Head board (20) and footboard (22) are preferable substantially identical in design and size. Both head board (20) and footboard (22) each are further defined by top edge (100), bottom edge (110), first side edge (120), and opposite side edge (125). Upper female coupling (130) is vertically mounted on outer face (121) near the top of first side edge (120) and opposite side edge (125). Lower female coupling (135) is vertically mounted on outer face (121) near the bottom of first side edge (120) and opposite side edge (125). Frame female connector (206) is mounted on the inner face (138) near the bottom of first side edge (120) and opposing side edge (125). Situated within a recess located behind upper female coupling (130) is locking mechanism (170) for securing the connection between upper female coupling (130) and upper male coupling (266) shown in FIG. 4A.

Figure 8:
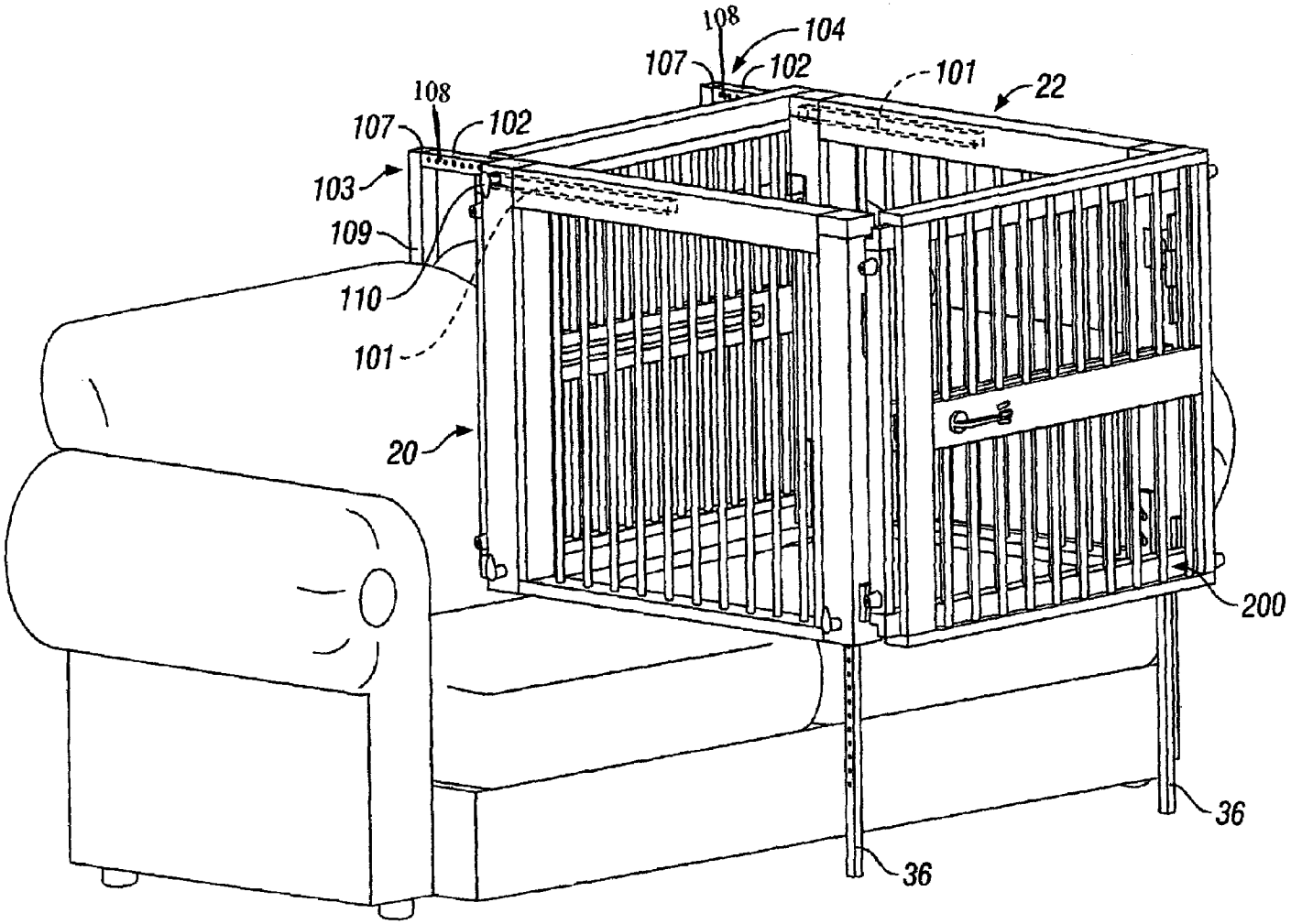
FIG. 8 illustrates the present invention assembled attached to the sofa.

Referring to FIGS. 4 and 8, the present invention further comprises L shape bracket member (103, 104) for use with a conventional sofa as shown. Each L shape bracket member (103, 104) each further comprises horizontal leg member (102) and vertical leg member (109). Disposed within top edge (100) of headboard (20) and footboard (22) is an internal conduit (101) which is adapted to telescopically receive horizontal leg member (102) of L shape bracket (103, 104). At perpendicular connection (107) horizontal leg member (102) extends linearly outward, and vertical leg member (109) extends linearly downward. Additionally, horizontal leg member (102) has a plurality of openings (108) situated across it horizontal axis. Each opening (108) is adapted to receive locking pin (110) such that the L shape bracket (103, 104) can be secured in place to a conventional sofa at a desired length as shown in FIG. 8.

Figure 10:
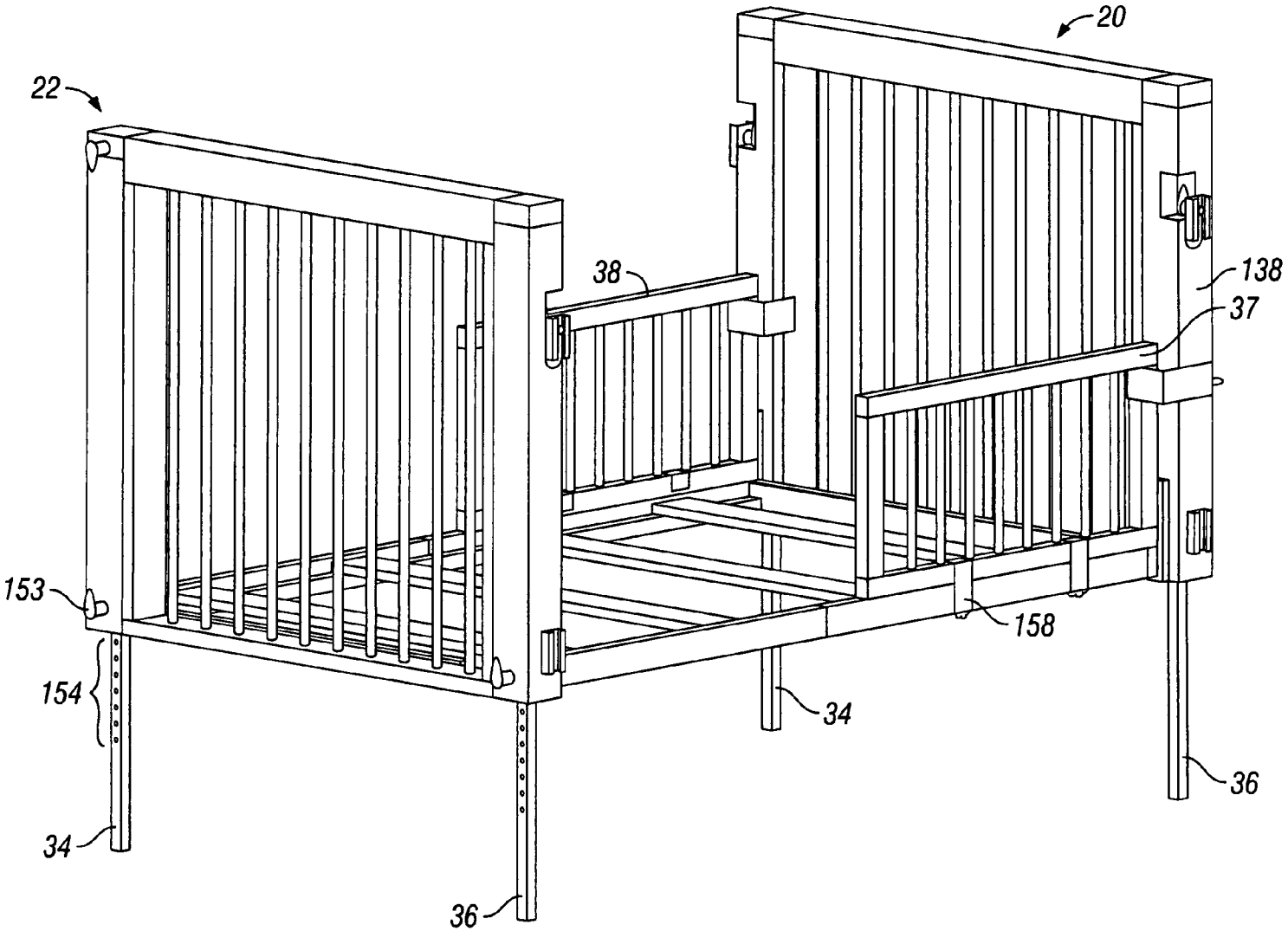
FIG. 10 illustrates the present invention assembled as a toddler bed.

Referring to FIG. 4, respectively disposed within the opposing lowermost section of first side edge (120) and opposing side edge (125) are first internal channel (30) and second internal channel (32). First internal channel (30) and second internal channel (32) are adapted to telescopically receive first leg member (34) and second leg member (36). First leg member (34) and second leg member (36) each are adapted with a locking mechanism to respectively secure in place to a desired length within first internal channel (30) and second internal channel (32). As shown in FIG. 10, each locking mechanism further comprises a plurality of holes (154) along the vertical axis of each leg member (34 and 36). Each hole (154) is adapted to receive locking pin (153) such that the leg member (34 and 36) can be secured in place at a desired length.

In use, to achieve a particular height locking pin (153) is removed from its current location on first leg member (34) and second leg member (36) of the bead board or footboard. Then, first leg member (34) and second leg member (36) each are extended or shortened to a desired height. Then locking pin (153) is respectively inserted into desired hole (154) used to secure first leg member (34) and second leg member (36) in place to a particular height.

Figure 5:
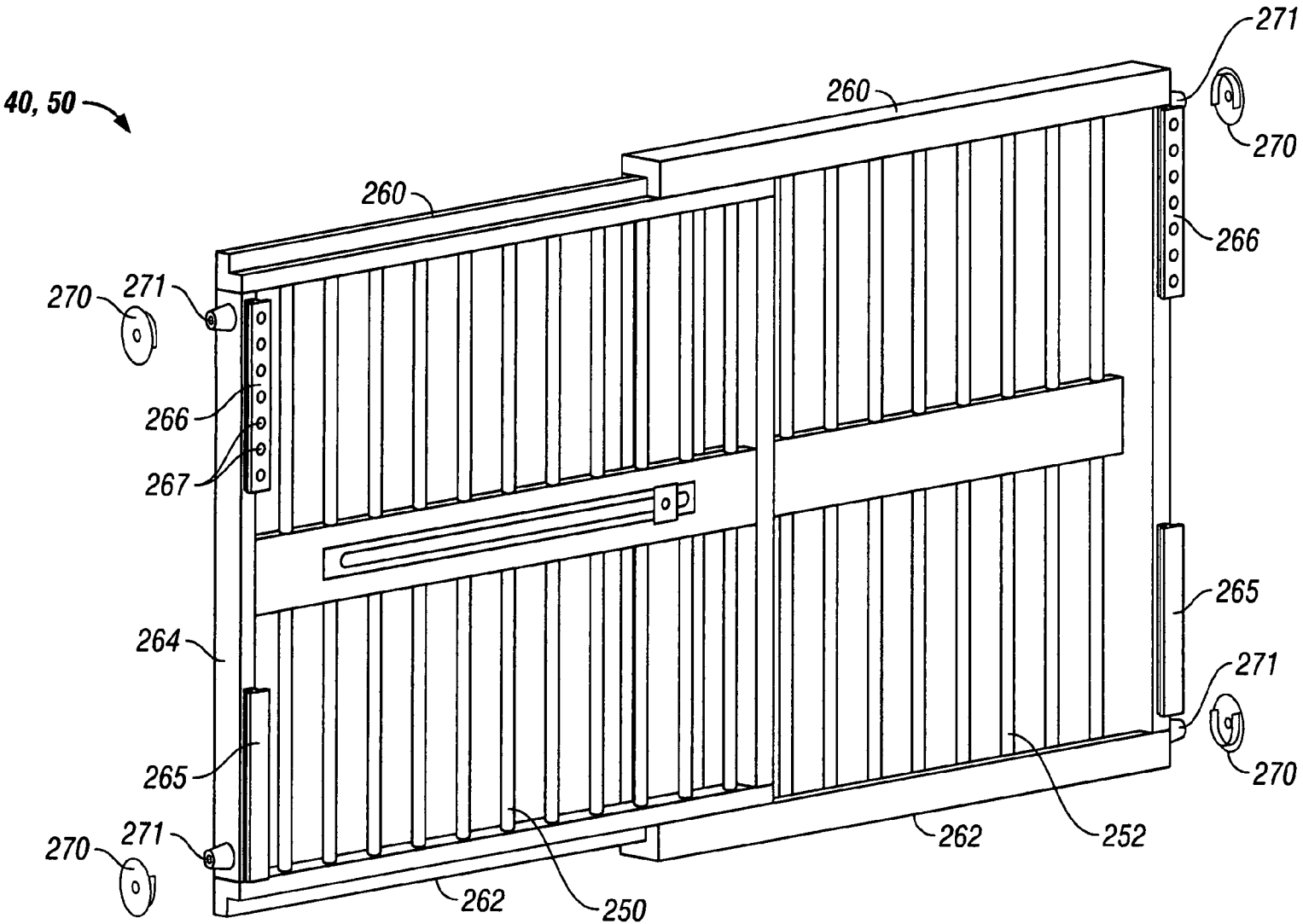
FIG. 5 illustrates a back view of the side panel.

First side panel (40) and second side panel (50) are preferable substantially identical in design and size. Referring to FIG. 5, first side panel (40) further comprises a first section member (250) and a second section member (252). Each section further comprises a top edge (260), bottom edge (262), and an outer side edge (264).

Figure 4A:
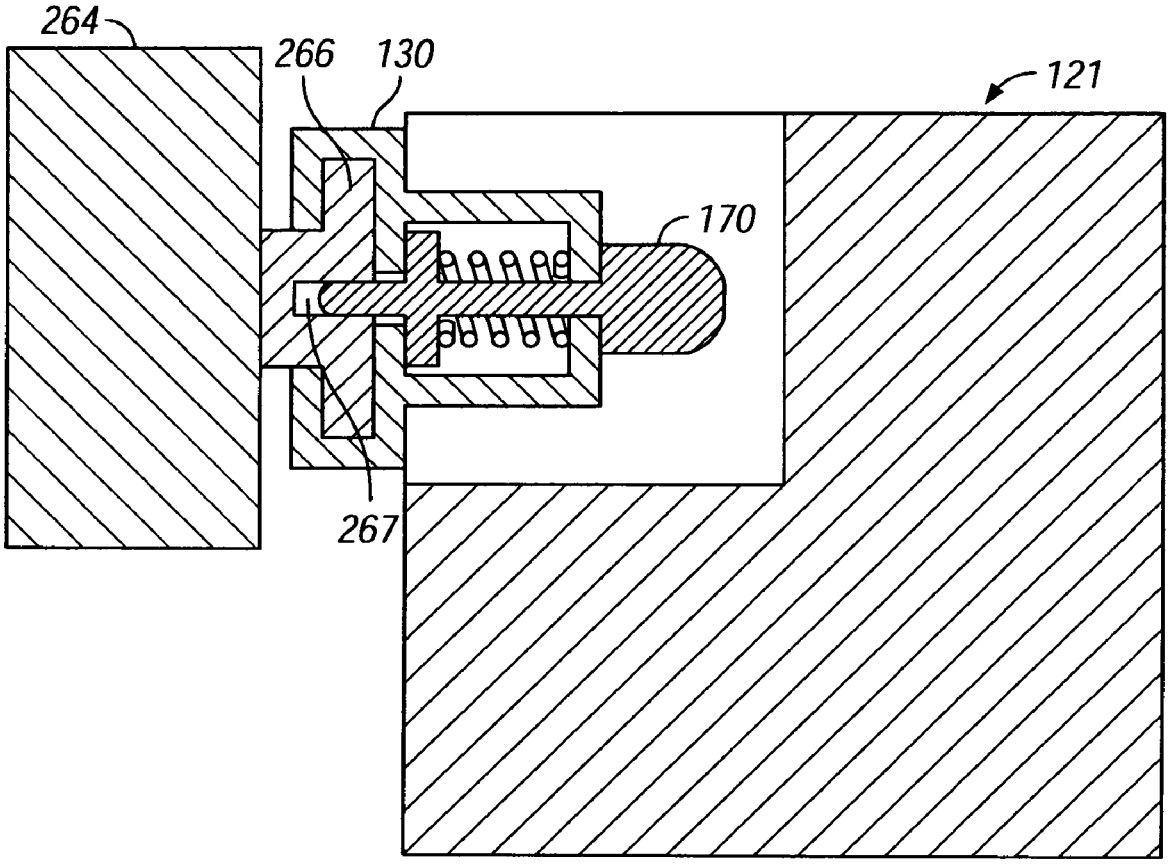
FIG. 4A illustrates the locking mechanism which supports the headboard and footboard connections.

Mounted to the upper most section of the inner face of outer side edge (264) is upper male coupling (266), and mounted to the lower most section of the inner face of outer side edge (264) is lower male coupling (265). Upper male coupling (266) and lower male coupling 265 are vertically mounted rectangular shape bracket member with a hollow inner cavity. Each female coupling (130, 135) has rectangular shaped complementary guide members. Each male coupling bracket member (266, 265) is adapted to slidably engage with each respective upper female coupling complementary guide member (130, 135) as shown in FIG. 4A. Upper male coupling (266) further comprises openings (267) along its vertical axis. Openings (267) are adapted to engage with locking mechanism (170). When slidably engaging side panel (40, 50) to headboard panel (20) and footboard panel (22), the locking mechanism (170) provides the capability of setting each side panel (40, 50) to a desired height.

Figure 5A:
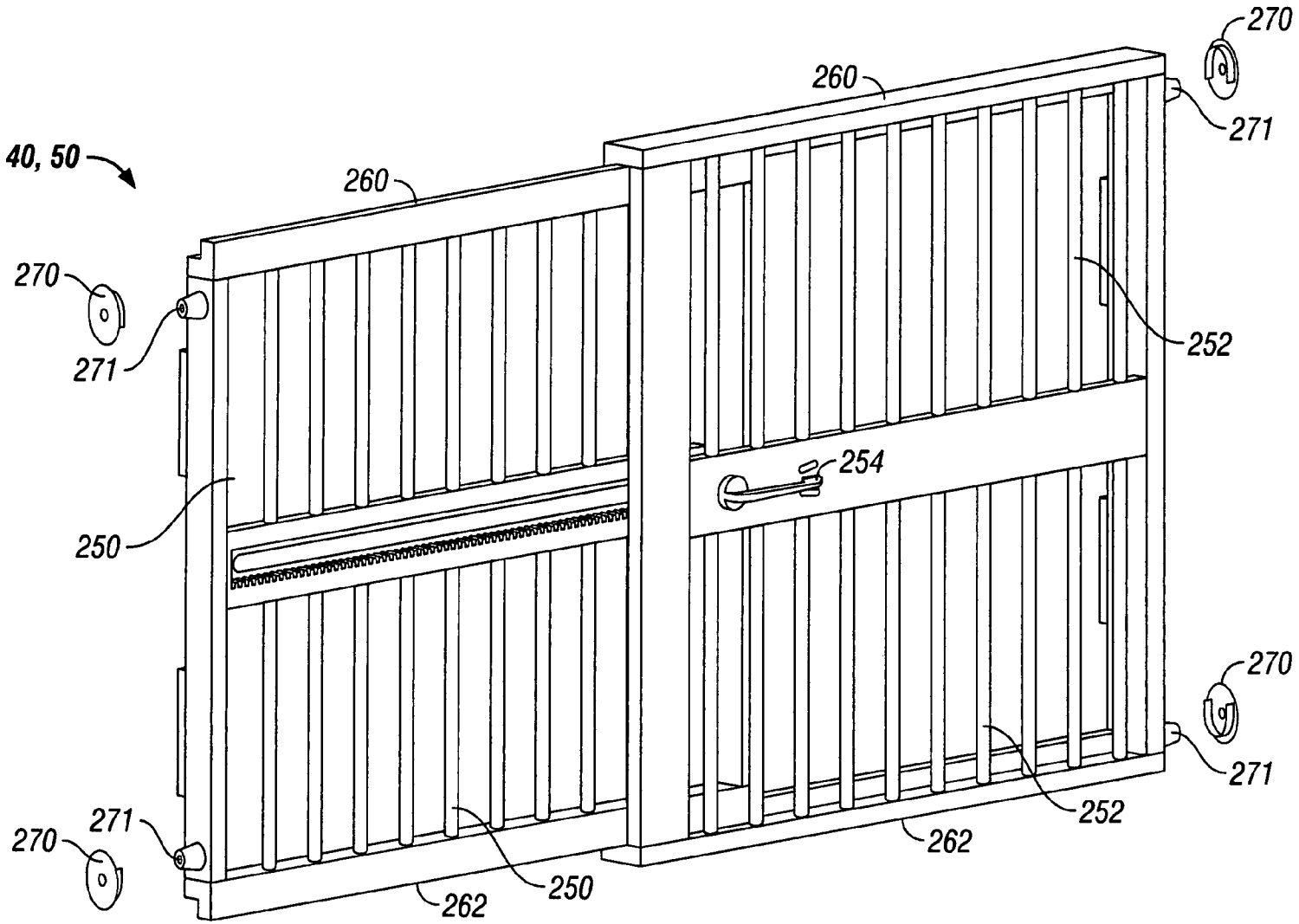
FIG. 5A illustrates a frontal view of the side panel.
Figure 5B:
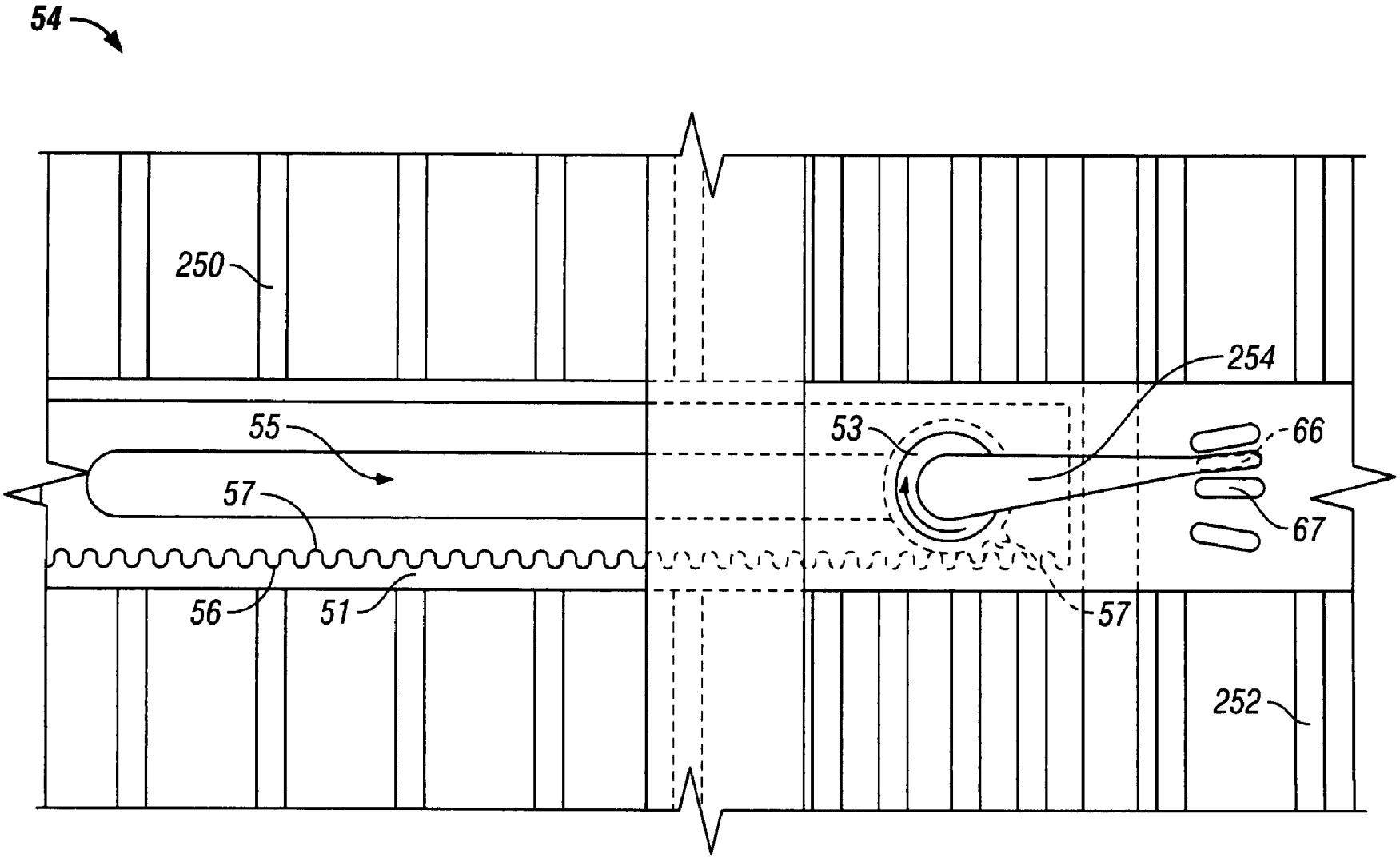
FIG. 5B illustrates an enlarged view of the rack member mounted on the side panel.

Referring to FIGS. 5, 5A, and 5B, interconnecting first section member (250) with second section member (252) is adjustable slidable mechanism (54). Referring to FIG. 5B, there is shown an enlarged view of adjustable slidable mechanism (54). Adjustable slidable mechanism (54) further comprises rack member (51) and gear (53). As shown in FIG. 5B, incorporated into first section member (250) is rack member (51) which is centrally located at an intermediate point on section (250) of side panel (40, 50). Rack member (51) further comprises a linearly rectangular shape central opening (55) extending substantially the length of first section member (250) with teeth (57) protruding outward on one side of central opening 55. Circular shape gear member (53) is rotatably mounted within the opening. Gear member (53) further comprises teeth (57) circumferentially surrounding the peripheral edges of gear member (53). Connected to gear member (53) is handle (254). Formed on the underside at the opposing end of handle (254) is a connector member (66) which is a small protruding rectangular bar. Teeth (57) of gear member (53) are meshed with teeth (56) of rack member (51) such that handle (254) can be rotated to secure panel (40, 50) in place. Openings (67) are formed on section (252) of panel (50) for securely engaging with connector member (66) to secure handle (254) in place.

As shown, the top edge (260) of first section member (250) and second section member 252 of panel (40, 50) and the bottom edge 262 of each section of a panel (40, 50) are adapted to be slidably interconnected allowing for the adjustment in length of panel (40, 50). Adjustable slidable mechanism 54 allows the length of first panel 40 to be adjusted to a desired length. For a smaller length, first section member 250 and second section member 252 is pushed inward along rack member 51 to a desired length. For a minimum length, first section member 250 and second section member 252 are pushed inward along rack member 51 until first section member 250 overlays section member 252 providing a total length of one section member. For a maximum length, first section member 250 and second section member 252 are pulled outward along rack member 51 to a desired length. For a maximum length, the first section member 250 and second section member 252 are pulled outward along rack member 51 to its maximum such that the inner linear edge of first section member 250 overlays the inner linear edge of second section member 252 providing a total length of approximately double the length of one section member.

Figure 9:
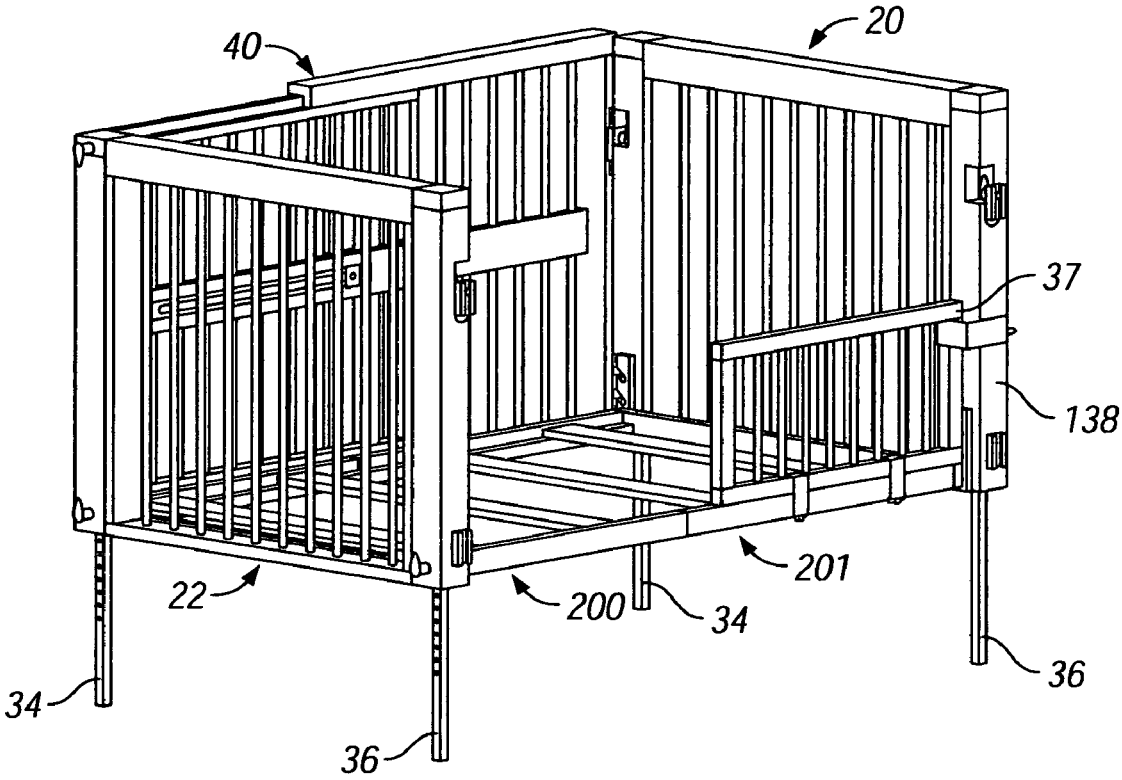
FIG. 9 illustrates the present invention assembled as a day bed.
Figure 9A:
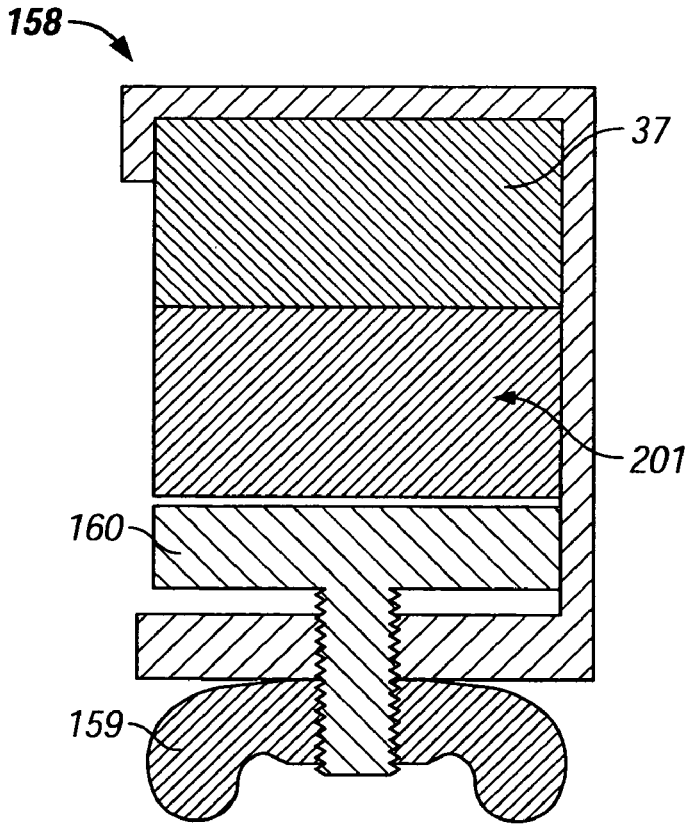
FIG. 9A illustrates the clamp member for the guard rail.

Referring to FIGS. 2, 9A, and 10, the convertible bed assembly further comprises a rectangular shape guard rail panel 37 and 38. In use the guard rail (37, 38) is removably mounted to the second base frame 201 of mattress assembly 199 in a perpendicular relation utilizing at least one clamp member 158. Each clamp member 158 have substantially a U shape with an internal diameter dimensioned to encircle the side of guard rail (37, 38) mounted onto the side of second base frame 201. A second clamp member 158 can be utilized to secure a side of guard rail panel (37, 38) to a side of the head board 20. When mounted, each clamp member 158 houses a compression member 160 which is aligned adjacent to the side of the guard rail. Referring to FIG. 9A, fastener 159 is adapted to securely and matingly engage with compression member 160 thereby creating a compression upon the side of guard rail (37,38) securing clamp member 158 in place with the side of second base frame 201 or the side of head board (20) or footboard (22).

Figure 6:
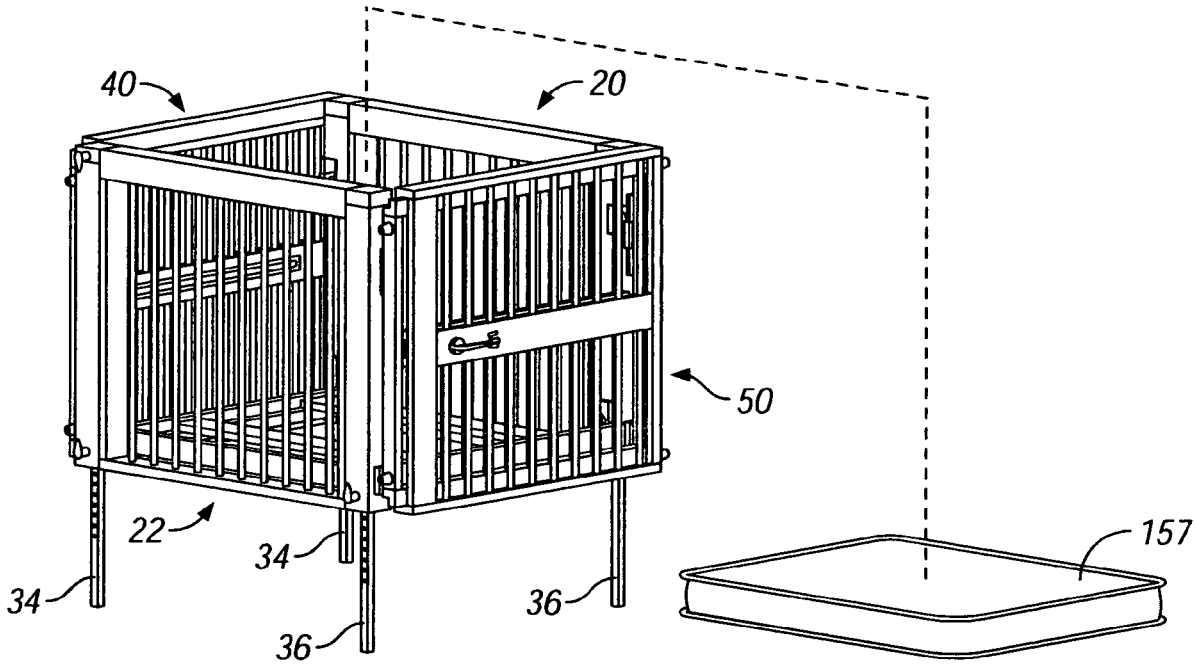
FIG. 6 illustrates the present invention assembled as a mini-crib.

As shown in FIG. 6, the convertible bed assembly may be convened into a mini-size crib utilizing first base frame (200) of mattress support assembly (199), head board 20, footboard 22, first side panel 40, and second side panel 50. Referring to FIGS. 1, 2, 3, 4, 5 and FIG. 6, in this configuration, firstly, frame male connectors (205) is removably mounted to each corner of closed side 212 of first base frame (200) is perpendicularly connected to frame female connectors (206) mounted to opposing ends of the lower end of headboard 20. Frame male connectors (205) is removably mounted to each corner of open side (215) of first base frame (200) is perpendicularly connected to frame female connectors (206) mounted to opposing ends of the lower end of footboard 22.

Then, first side panel 40 and second side panel 50 each are slidably adjusted into their minimum length on rack member 51. On opposing sides of head board 20 and footboard 22, each panel (40, 50) is respectively connected to head board 20 and foot board 22 in a perpendicular relation. In order to effect the connection between panel 40, 50 to head board 20 and foot board 22, first, the upper female coupling 130 and lower female coupling 135 is removably mounted to the inner face on opposing sides 264 of side panel (40) are slidably engaged in a perpendicular relation with the upper male coupling 266 and lower male coupling 265 mounted to outer face (121) of opposing parallel sides 125 of headboard 20 and foot board 22. Secondly, the upper female coupling 130 and lower female coupling 135 mounted to the inner face on opposing sides 264 of side panel (50) are slidably engaged in a perpendicular relation with the upper male coupling 266 and lower male coupling 265 mounted to outer face of opposing parallel sides 120 of headboard 20 and foot board 22. All four leg members (34, 36) are adjusted and secured to the desired height with locking pin 153 as shown in FIG. 10. Support slats (208) are inserted onto the mattress assembly 199 for supporting the mini-size crib mattress 157.

Figure 6A:
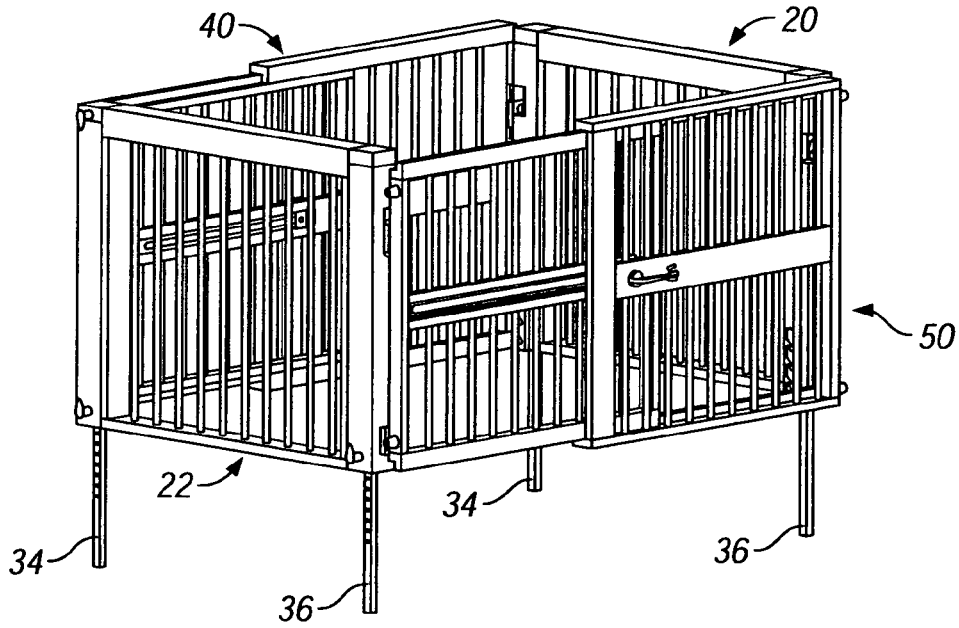
FIG. 6A illustrates the present invention assembled as a full-crib.

As shown in FIG. 6A, the convertible bed assembly may be converted into a full-size crib utilizing first base frame (200) and second base frame 201 of mattress support assembly (199), head board 20, footboard 22, first side panel 40, and second side panel 50. Referring to FIGS. 1, 2, 3, 4, 5, 5B, and FIG. 6A, in this configuration, firstly, frame male connectors (205) is removably mounted to each corner of closed side (212) of base frame (200) is perpendicularly connected to frame female connectors (206) mounted to opposing ends of the lower end of headboard 20. Frame male connectors (205) is removably mounted to each corner of open side (215) of first base frame (200) is perpendicularly and removably connected to frame female connectors (206) mounted to opposing ends of the open side 215 of base frame 201. Frame male connectors (205) is removably mounted to each corner of closed side (212) of second base frame (201) is perpendicularly and removably connected to frame female connectors (206) mounted to opposing ends of the lower end of footboard 22.

Then, first side panel 40 and second side panel 50 each are slidably adjusted into their maximum length on rack member 51. On opposing sides of head board 20 and footboard 22, each panel (40, 50) is respectively connected to head board 20 and foot board 22 in a perpendicular relation. In order to effect the connection between panel 40, 50 to head board 20 and foot board 22, first, the upper female coupling 130 and lower female coupling 135 is removably mounted to the inner face on opposing sides 264 of side panel (40) are slidably engaged in a perpendicular relation with the upper male coupling 266 and lower male coupling 265 mounted to outer face of opposing parallel sides 125 of headboard 20 and foot board 22. Secondly, the upper female coupling 130 and lower female coupling 135 mounted to the inner face on opposing sides 264 of side panel (50) are slidably engaged in a perpendicular relation with the upper male coupling 266 and lower male coupling 265 mounted to outer face of opposing parallel sides 120 of headboard 20 and foot board 22. All four leg members (34, 36) are adjusted and secured to the desired height with locking pin 153 shown in FIG. 10. Support slats (208) are inserted onto the mattress assembly 199 for supporting a conventional full-size crib mattress.

As shown in FIG. 8, the convertible bed assembly may be converted into a sofa crib utilizing foot board 20, head board 22, first side panel 40, and second side panel 50. Referring to FIGS. 1, 2, 3, 4, 5 and FIG. 8, in this configuration, mini-size crib is assembled as described above. The length of L shape bracket members (103, 104) are adjusted to attach the top of the sofa and then secured in place with pin 110. Each outer leg member 36 of headboard 22 and footboard 20 are adjusted and secured to the desired height with locking pin 153 shown in FIG. 10. Each inner leg member (34) of headboard 22 and footboard 20 are removed to allow the underside of first base frame (200) of mattress assembly 199 to sit on the top up the sofa as shown in FIG. 8. In an alternative embodiment, mini-size mattress 157 can be utilized.

Figure 7:
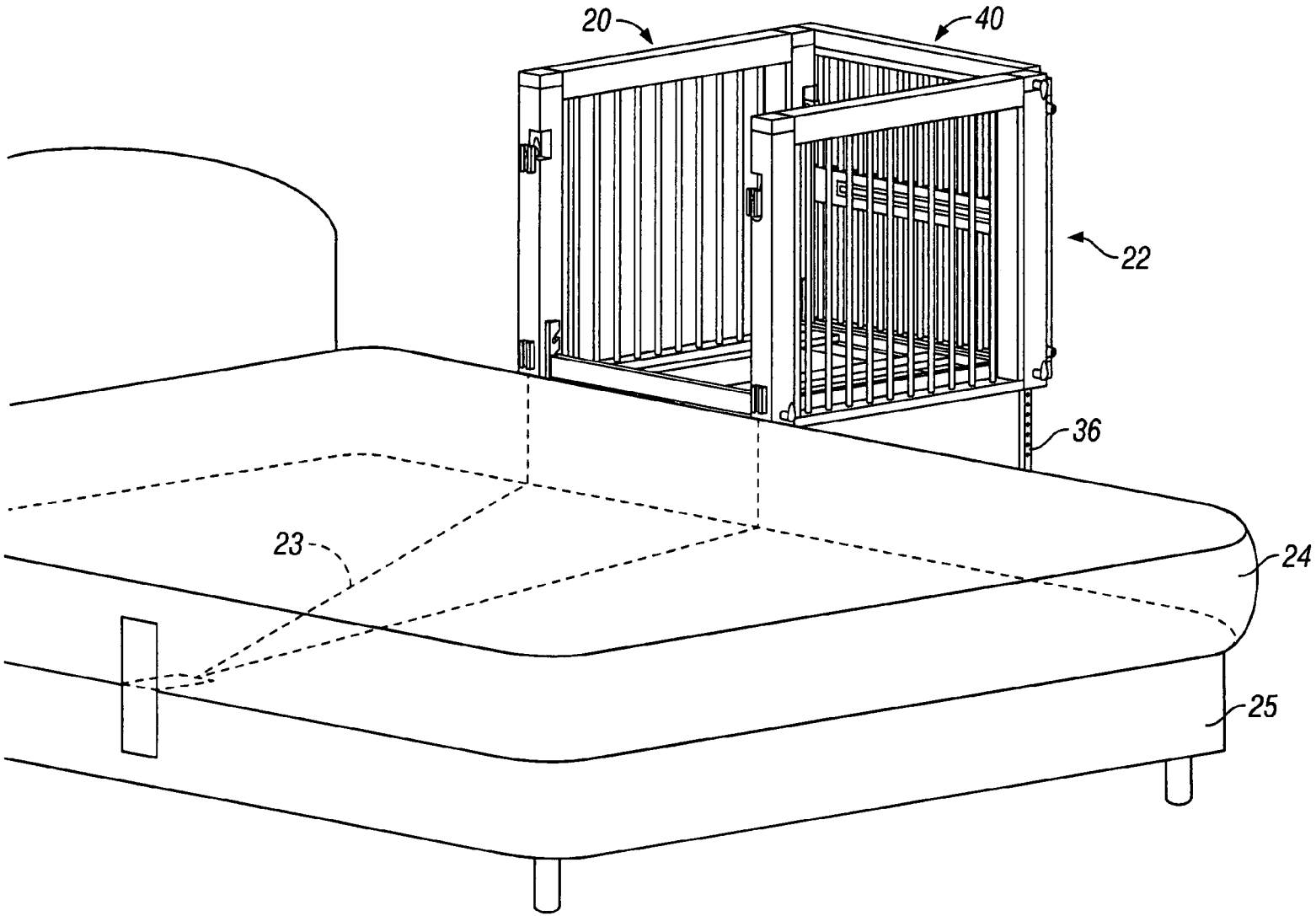
FIG. 7 illustrates the present invention assembled as a bed side crib.

As shown in FIG. 7, the convertible bed assembly may be converted into a bed side crib utilizing first base frame 200 of mattress support assembly 200, head board 20, footboard 22, first side panel 40, mini-size mattress 157, and bungee cord 23. Referring to FIGS. 1, 2, 3, 4, 5 and FIG. 7, in this configuration, mini-size crib is assembled as described above without first side panel 40 or second side panel 50 thereby allowing closed side (212) of first base frame 200 to be aligned with the lower edge of the box spring of the bed. On end of the bungee cords is attached to the closed side 212 of first base frame 200. From one side the box spring the bungee cord 23 is extended through and between the mattress 24 and box spring 25 securely connecting to the opposite side of the box spring 25. All four leg members (34, 36) are adjusted and secured to the desired height using locking pin 153 shown in FIG. 10. Support slats 208 are inserted onto first base frame 200 of mattress frame assembly 199 for supporting mini-size mattress 157.

As shown in FIG. 9, the convertible bed assembly may be convened into a day bed utilizing first base frame (200) and second base frame 201 of mattress support assembly (199), bead board 20, footboard 22, first side panel 40, and guard rail 37. Referring to FIGS. 1, 2, 3, 4, 5 and FIG. 9, in this configuration, firstly, frame male connectors (205) mounted to each corner of closed side (210) of first base frame (200) is perpendicularly connected to frame female connectors (206) mounted to opposing ends of the lower end of headboard 20. Frame male connectors (205) is mounted to each corner of open side (215) of first base frame (200) is perpendicularly connected to frame female connectors (206) mourned to opposing ends of the open side 215 of base frame 201. Frame male connectors (205) is mounted to each corner of closed side (212) of second base frame (201) is perpendicularly connected to frame female connectors (206) mounted to opposing ends of the lower end of footboard 22.

Then, first side panel 40 is slidably adjusted into its maximum length on rack member 51. On opposing sides of head board 20 and footboard 22, panel 40 is respectively connected to head board 20 and foot board 22 in a perpendicular relation. In order to effect the connection between panel 40 to head board 20 and foot board 22, first, the upper female coupling 130 and lower female coupling 135 mounted to the inner face on opposing sides 264 of side panel (40) are slidably engaged in a perpendicular relation with the upper male coupling 266 and lower male coupling 265 mounted to outer face of opposing parallel sides 125 of headboard 20 and foot board 22. Guard rail panel 37 is removably and perpendicularly mounted to the second base frame 201 opposing side panel 40. All four leg members (34, 36) are adjusted and secured to the desired height using locking pin 153 shown in FIG. 10. Support slats 208 are inserted onto mattress frame assembly 199 for supporting a conventional full-size mattress.

As shown in FIG. 10, the convertible bed assembly may be converted into a toddler bed utilizing first base frame (200) of mattress support assembly (199), head board 20, footboard 22, first guard rail panel 37 and second guard rail panel 38. Referring to FIGS. 1, 2, 3, 4 and FIG. 10, in this configuration, firstly, frame male connectors (205) mounted to each corner of closed side (212) of first base frame (200) is perpendicularly connected to frame female connectors (206) is mounted to opposing ends of the lower end of headboard 20. Frame male connectors (205) mounted to each corner of open side (215) of first base frame (200) is perpendicularly connected to frame female connectors (206) mounted to opposing ends of the open side 215 of base frame 201. Frame male connectors (205) is mounted to each corner of closed side (212) of second base frame (201) is perpendicularly connected to frame female connectors (206) mounted to opposing ends of the lower end of footboard 22. Leg members (34, 36) are adjusted and secured to the desired height. Guard rail panel 37 and 38 are removably and perpendicularly mounted to the opposing sides of first base frame 201 in a parallel relation as shown in FIG. 10. Support slats 208 are inserted onto mattress frame assembly 199 for supporting a conventional full-size mattress.

Additionally, as shown in FIGS. 5 and 5A, convertible bed assembly may be converted into a security gates utilizing first side panel 40, and second side panel 50. Security stoppers 271 are removably mounted to the opposing side of first panel 40 or second side panel 50. Door support stoppers 270 are removably mounted to the door frame or wall for receiving security stoppers 271. First section member 250 and second section member 252 of first side panel 40 are adjusted into the desired length and placed with the lower edge perpendicular to the floor with the security stoppers 270 inserted into door stoppers 271. Handle 254 is rotated until first side panel 40 is secured in place within door support stoppers 270.

Figure 11:
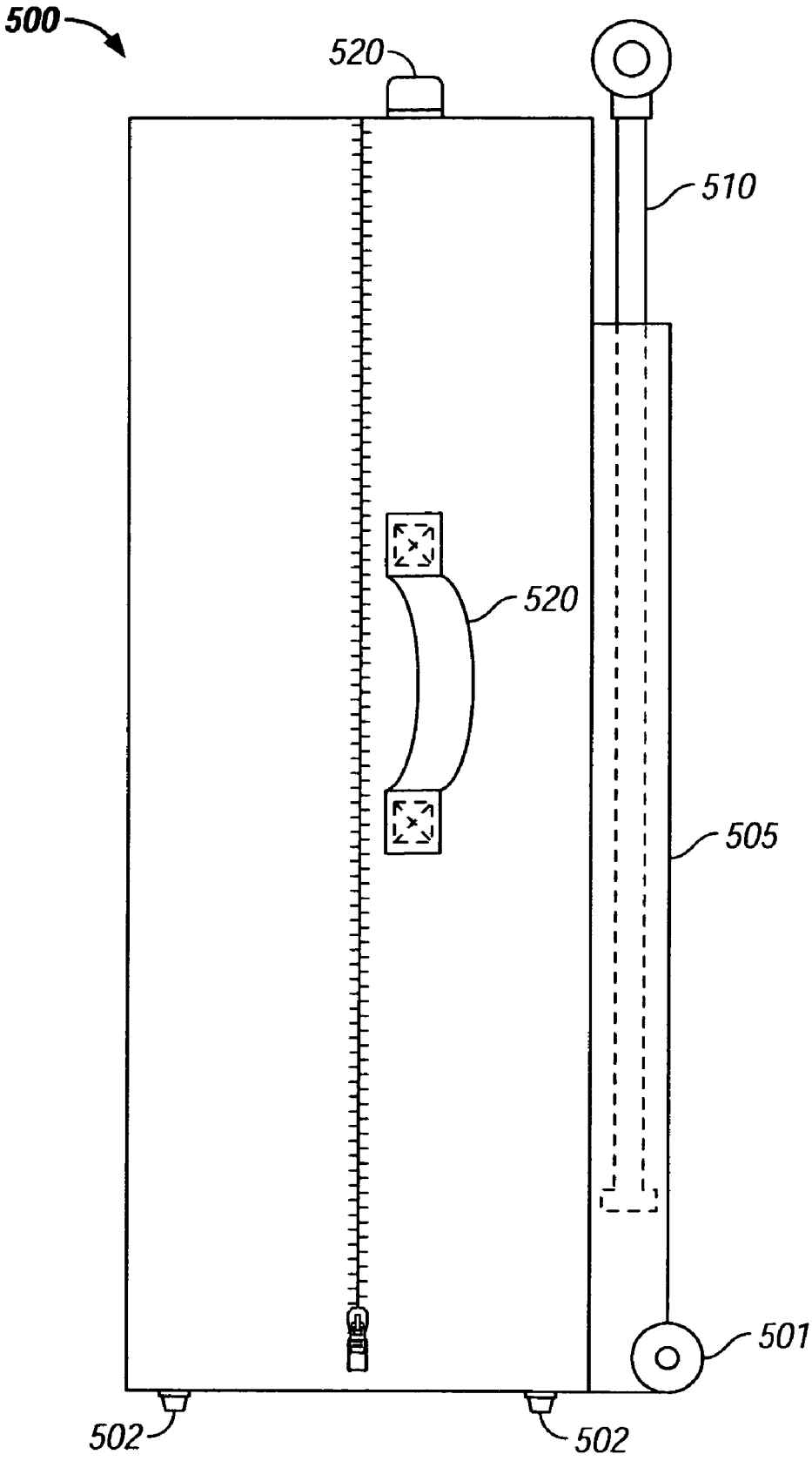
FIG. 11 illustrates the carrying bag for the present invention.

Referring to FIG. 11, there is shown a side view of the configuration of a carrying case. Carrying case (500) is dimensioned to accommodate carrying the disassembled components of the convertible bed assembly. The base of the carrying case (500) is supported by wheels (501) and small protruding legs (502). Carrying case (500) further comprises an elongated rectangular shape housing attached to an elongated support member (505). A telescoping handle (510) is connected to the top of the elongated support member (505) and wheels (501) are attached to the bottom of the support member (505). Handle 520 is attached to the top of the carrying case (500) and handle 510 is attached to the side of carrying case (500). Wheels 501 allow the load to be easily transported from one place to the other.

What is claimed is:

1. A multi-purpose convertible crib assembly, the assembly comprising: a plurality of removable interconnecting components comprising: a headboard panel and a footboard panel having substantially the same size and dimensions, each panel having a rectangular shape defined by a top edge, a lower edge, a first side edge, and an opposing side edge; a pair of adjustable leg members attached to the underside at each opposing corner of the lower edge of each panel; a mattress support assembly having a first base frame member and a second base frame member, each frame member having a partially enclosed rectangular shape and being defined by a open side, an opposing closed side, a first side edge, and an opposing second side edge, the first side edge and the opposing second side edge of the first frame member having slightly larger dimensions than each corresponding side edge of the second frame member, the first frame member dimensioned to support a mini-size crib mattress; a first side panel and a second side panel having substantially the same dimensions, each panel having a first section member and second section member, each section member having a rectangular shape defined by a top edge, a lower edge, a outer linear edge, an opposing inner linear edge, an inner surface, and an outer surface, the top edge and the bottom edge of the first section member being respectively slidably engaged in a horizontal direction with the respective top edge and the bottom edge of the second side section member; an adjustable mechanism slidably interconnecting the inner linear edge of the first section member to the inner linear edge of the second section member forming the first and second side panel with each panel having opposing outer linear edges, the adjustable slidable mechanism formed by a first member cooperatively engaged with a second member, the first member incorporated within the first section member and the second member incorporated within the second section member allowing the adjustable mechanism to horizontally extend inwardly to a minimum length and to horizontally extend outwardly to a maximum length; a handle mounted to the adjustable mechanism extending outwardly from the outer surface of the second section member, the handle having means for locking a side panel to a desired length; and a means for alternatively and selectively assembling the plurality of components into a mini-size crib, a full-size crib, a sofa bed crib, a day bed, a toddler bed, a bed-side crib and at least one security gate configuration.

2. The multi-purpose crib of claim 1 further comprising: a first connector means for perpendicularly and removably connecting the lower edge of the headboard panel or the footboard panel to the closed side of the first frame member, the first side edge and the opposing second side edge of the headboard or footboard panel extending vertically upward therefrom; a second connector means for perpendicularly and removably connecting the lower edge of the headboard panel or the footboard panel to the open side of the first frame member, the first side edge and the opposing second side edge of the headboard panel or the footboard panel extending vertically upward therefrom; a third connector means for removably attaching the opposing outer linear edges of the first side panel to the first side edge of the first headboard panel and the footboard panel; a fourth connector means for removably attaching the opposing outer linear edges of the second side panel to the second side edge of headboard panel and the footboard panel; a fifth connector means for removably interconnecting the open side of the first base frame member to the open side of the second base frame member forming an enclosed rectangular structure; and a sixth connector means for perpendicularly and removably connecting the lower edge of either guard rail panel to either side edge of either frame member, the first side edge and the opposing second side edge of the connected extending vertically upward therefrom.

3. The multi-purpose crib of claim 2 wherein the plurality of components further comprises: a L-shape bracket having a vertical leg member and a horizontal leg member; the horizontal leg member and the vertical leg member; a channel disposed within the top edge of the headboard panel and the top edge of the footboard panel, the channel adapted to telescopically receive the horizontal leg member.

4. The multi-purpose crib of claim 3 wherein the means for alternatively and selectively assembling the plurality of components into the sofa crib configuration further comprises: the first connector means perpendicularly and removably connecting the lower edge of the headboard panel to the opposing closed side of the first frame member the second connector means perpendicularly and removably connecting the lower edge of the footboard panel to the open side of the first frame member; the top and bottom edges of the first and the second side panel being slid inwardly setting the adjustable mechanism to the minimum length; and the third connector means removably attaching the opposing outer linear edges of the first side panel to the first side edge of the first headboard panel and the footboard panel; and the fourth connector means removably attaching the opposing outer linear edges of the second side panel to the second side edge of headboard panel and the footboard panel, such that a mini-size crib structure is formed; the mini-size crib structure being situated on a flat bed of the sofa and the vertical leg member of the L-shape bracket secured to a backside of the sofa; and a pair of leg members extended downward to a desired length wherein the mini-size crib structure is secured in place upon the sofa.

5. The multi-purpose crib of claim 2 wherein the plurality of components further comprises: a first and second guard rail panel having substantially the same size and shape: each guard rail panel having a rectangular shape defined by a top edge, bottom edge, first side edge, and an opposing side edge, the guard rail having smaller dimensions than the first or second side panel.

6. The multi-purpose crib of claim 5 wherein the means for alternatively and selectively assembling the components into the day bed configuration further comprising: the fifth connector means removably interconnecting the open side of the first base frame member to the open side of the second base frame member forming an enclosed rectangular structure for supporting a full size crib mattress; the first connector means perpendicularly and removably connecting the lower edge of the headboard panel to the opposing closed side of the first frame member, the second connector means perpendicularly and removably connecting the lower edge of the footboard panel to the opposing closed side of the second frame member forming opposing first side edges and opposing second side edges, the top and bottom edges of the first side panel being slid outwardly to their maximum length; and the third connector means removably attaching the opposing outer linear edges of the one side panel to the opposing first side edges; the sixth connector means perpendicularly and removably connecting the lower edge of the first guard rail panel to side edge of the frame member directly opposite to the side panel, thereby forming the daybed crib structure.

7. The multi-purpose crib of claim 5 wherein the means for alternatively and selectively assembling the components into the toddler bed configuration further comprises: the fifth connector means removably interconnecting the open side of the first base frame member to the open side of the second base frame member forming an enclosed rectangular structure for supporting a full size crib mattress; the first connector means perpendicularly and removably connecting the lower edge of the headboard panel to the opposing closed side of the first frame member, the second connector means perpendicularly and removably connecting the lower edge of the footboard panel to the opposing closed side of the second frame member forming opposing first side edges and opposing second side edges, the sixth connector means perpendicularly and removably connecting the lower edge of the first guard rail panel to the side edge of either base frame member; the sixth connector means perpendicularly and removably connecting the lower edge of the second guard rail panel to the side edge of the base frame member directly opposite the first guard rail pane thereby forming the toddler bed structure.

8. The multi-purpose crib of claim 2 further comprising: a support mechanism mounted to the underside of each corner of the open side of the first frame member; and the support mechanism for supporting the connection between the first frame member and the second frame member when forming the full-size crib structure.

9. The multi-purpose crib of claim 8 wherein the support mechanism further comprises: a plate member rotatably mounted to the underside of each corner of the open side of the first frame member; and the plate member dimensioned to support the connection between the first frame member and the second frame member when forming the full-size crib structure, preventing sagging of the connection.

10. The multi-purpose crib of claim 2 wherein the plurality of components further comprises a stretchable bungee cord having a first securing mechanism at one end and a second securing mechanism at the opposing second end.

11. The multi-purpose crib of claim 10 wherein the means for alternatively and selectively assembling the components into the bed side crib configuration further comprising: the second connector means perpendicularly and removably connecting the lower edge of the headboard panel to the open side of the first frame member, the top and bottom edges of first and second side panel being slid inwardly setting the adjustable mechanism to their minimum length; and the third connector means removably attaching an outer linear edge of the first side panel to the first side edge of the headboard panel; the third connector means removably attaching an outer linear edge of the second side panel to opposing second side edge of headboard panel, wherein the bedside crib configuration is form; the first securing mechanism of the bungee cord being removably attached to the opposing closed side of the first frame member with the bungee cord extending therefrom and therebetween a box spring overlaying a mattress of a bed to a second securing mechanism having means for securing the bedside crib structure in place to the bed.

12. The multi-purpose crib of claim 2 wherein the first connector means and the second connector means further comprises: a female frame connector member and a mating male frame connector member; the female frame connector member being firmly mounted to each opposing comas of the open side of the first frame member, the male frame connector member being firmly mounted to each opposing corners of the opposing closed side of the second frame member and a means for securely engaging the female frame connector member with the male frame connector member.

13. The multi-purpose crib of claim 12 further wherein the frame male connector further comprises: at least one locking pin having a short rod defined by a first end and an opposing second end; a head integrated at the first end and the opposing second end firmly mounted each opposing corner of the opposing closed side of the second frame member.

14. The multi-purpose crib of claim 13 wherein the frame female connector member further comprises: a bracket member having at least one diagonally oriented slots; the at least one slot having an opening at one end adapted to receive the head of the locking pin wherein the locking pin slidably lock in place when the connection between the male frame connector member and the female frame connector member is made.

15. The multi-purpose crib of claim 2 wherein the third and fourth connector means further comprising: a guide member disposed upon the top edge of the first section member; and a channel disposed within the top edge of the second section member, the channel adapted to slidably receive the guide member.

16. The multi-crib assembly of claim 2 wherein the means for alternatively assembling the components so as to selectively configure a mini-size crib configuration further comprising: the first connector means removably attaching the headboard panel to the opposing closed side of the first frame member; the second connector means removably attaching the footboard panel to the open side of the first frame member forming an enclosed rectangular structure for supporting a mini-size crib mattress; the top and bottom edges of first and second side panel being slid inwardly setting the adjustable mechanism to their the minimum length; the third connector means removably attaching the outer linear edges of the first side panel to the first side edge of the first headboard panel and the footboard panel; and the fourth connector means removably attaching the outer linear edges of the second side panel to the second side of the headboard panel and the footboard panel, wherein a box like structure is formed for supporting the mini-size crib structure.

17. The multi-crib assembly of claim 2 the means for alternatively assembling the components so as to selectively configure the full-size crib configuration further comprising: the fifth connector means removably interconnecting the open side of the first base frame member to the open side of the second base frame member forming an enclosed rectangular structure for supporting a full size crib mattress; the first connector means perpendicularly and removably connecting the lower edge of the headboard panel to the opposing closed side of the first frame member, the second connector means perpendicularly and removably connecting the lower edge of the footboard panel to the opposing closed side of the second frame member; the top and bottom edges of first and second side panel being slid outwardly to their maximum length; the third connector means for removably attaching the opposing outer linear edges of the first side panel to the first side edge of the first headboard panel and the footboard panel; and the fourth connector means for removably attaching the opposing outer liner edges of the second side panel to the second side edge of headboard panel and the footboard panel, wherein a box like structure is formed for supporting the full-size crib configuration.

18. The multi-crib assembly of claim 2 further comprising a means for alternatively assembling the components so as to selectively configure the components into at least one security gate configuration comprising: a pair of stoppers being removably attached near the top and the bottom of the opposing outer linear edges of first and second side panel, the first side panel or the second side panel is slidably adjusted to a desired length; and the locking mechanism within the handle adapted to secure the panel to the desired length.

19. The multi-crib assembly of crib 2 wherein the third and fourth connector member each further comprises an upper male coupling and a mating upper female coupling; an lower male coupling and a mating lower female coupling; the upper male coupling being firmly mounted to an inner face of the upper most section of the outer linear edge of first and second side panel; the lower male coupling being firmly mounted to an inner face of the lower most section of the outer linear edge of first and second side panel; the upper male coupling being fixably mounted to the an inner face of the upper most section of the outer linear edge; the lower female coupling being firmly mounted to an outer face of the lower most section of each side edge of each headboard and each footboard; the upper female coupling being firmly mounted to an outer face of the upper most section of each side edge of each headboard and each footboard; a means for securely engaging the upper female coupling to the mating upper male coupling; and a means for securely engaging the lower female coupling to the mating lower male coupling.

20. The multi-crib assembly of claim 19 wherein the upper and lower male coupling each further comprises a bracket member having a hollow interior cavity.

21. The multi-assembly of claim 20 wherein the upper and lower female coupling each further comprises: a complementary guide member; and the complementary guide member adapted to slidably engage with the interior cavity of the bracket member.

22. The multi-assembly of claim 1 further comprising: a rack member interconnecting the first section member to the second section member; a gear member rotationally and slidably mounted in a horizontal direction within the rack member allowing the length of first and second side panel to be adjusted in length; the handle being coupled to the gear member and extending outwardly therefrom; and the handle having a mechanism for securing first and second side panel to a desired length.

23. A kit for assembling a multi-purpose crib into a plurality of configurations including a full-size, mini-size, bed-side, sofa bed, day bed, toddler bed, or security gates, the kit comprising: a headboard panel and a footboard panel of substantially the seine size and dimensions, each panel having a rectangular shape defined by a top edge, a lower edge, a first side edge, and an opposing side edge; an adjustable leg member attached to the underside of each corner of the lower edge of each panel; a mattress support assembly having a first base frame member and a second base frame member, each frame member having a partially enclosed rectangular shape and being defined by a open side, a opposing closed side, a first side edge, and an opposing second side edge, the first side edge and the opposing second side edge of the first frame member having slightly larger dimensions than each corresponding side edge of the second frame member, the first frame member dimensioned to support a mini-size crib mattress; a first side panel and a second side panel having substantially the same size and shape, each panel having a first section member and second section member, each section member having a rectangular shape defined by a top edge, a lower edge, a outer linear edge, an opposing inner linear edge, an inner surface, and an outer surface, the top edge and the bottom edge of the first section member being slidably engaged in a horizontal direction with the second side section member; an adjustable mechanism slidably interconnecting the outer surface of the first section member to the inner surface of the second section member forming a side panel with opposing outer linear edges, the adjustable mechanism disposed between the first section member and the section member at an intermediate location near the inner linear edge allowing the adjustably mechanism to horizontally extend inwardly to a minimum length and to horizontally extend outwardly to a maximum length; and a handle mounted to the adjustable mechanism extending outwardly from the outer surface of the second section member, the handle having means for locking a side panel to a desired length.

24. The kit of claim 23 further comprising a first and second guard rail panel having a rectangular shape with dimensions smaller than the first or second side panel.

25. The kit of claim 23 further comprising a stretchable bungee cord being removably connected to the either frame member for securing the assembled bedside crib to a bed.

26. The kit of claim 23 further comprising an L shapes bracket being removably and slidably engage with the top edge of the headboard or footboard panel, the L shaped bracket for securing the assembled sofa bed crib to a sofa.

27. The kit of claim 23 wherein further comprising: a carrying case having an interior cavity dimensioned to encompassed the kit; and the case being supported by wheels with an attached handle.

* * * * *